US005819610A

United States Patent [19]

Brannan

[11] Patent Number: 5,819,610

[45] Date of Patent: Oct. 13, 1998

[54] COMBINATION HAND TOOL

[76] Inventor: Cameron Brannan, 1326 North Road Box 767, Gibsons, Canada, V0N 1V0

[21] Appl. No.: 865,610

[22] Filed: May 29, 1997

[51] Int. Cl.[6] ..... B25F 1/00

[52] U.S. Cl. ..... 81/437; 81/439; 7/138

[58] Field of Search ..... 81/437, 439; 7/138

[56] References Cited

U.S. PATENT DOCUMENTS

| | | | |
|---|---|---|---|
| D. 197,915 | 4/1964 | Ayars | 81/439 |
| 2,148,573 | 2/1939 | Mulcay | 81/437 |
| 2,383,573 | 8/1945 | Tomsek | 81/437 |
| 2,515,558 | 7/1950 | Kluth | 81/439 |
| 2,643,566 | 6/1953 | Dos Santos et al. | 81/437 |
| 4,089,077 | 5/1978 | Morton | 7/138 |
| 5,652,988 | 8/1997 | Appelhoff | 81/437 |

FOREIGN PATENT DOCUMENTS

| | | | |
|---|---|---|---|
| 992395 | 10/1951 | France | 81/439 |

*Primary Examiner*—David A. Scherbel
*Assistant Examiner*—Joni B. Danganan

[57] ABSTRACT

A new combination hand tool for permitting removal of variously shaped stoppers or bungs from a barrel. The inventive device includes an elongate handle member with a tool member mounted on it at one end. The tool member has a plurality of flat tab portions for insertion into a slot provided on a bung and a web portion having a hex-shaped hole extending through it for engaging securing nuts provided on a bung.

9 Claims, 2 Drawing Sheets

10
24
20
36
38
30
22
35
32
2
34
1

38
36
30
22

32
10
35
34

COMBINATION HAND TOOL

BACKGROUND OF THE INVENTION

1. Field of the Invention

The present invention relates to hand tools and more particularly pertains to a new combination hand tool for permitting removal of a stopper or bung from a barrel.

2. Description of the Prior Art

The use of hand tools is known in the prior art. More specifically, hand tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art hand tools include U.S. Pat. No. 4,597,123; U.S. Pat. No. 4,089,077; U.S. Pat. No. 4,716,610; U.S. Pat. No. 5,121,661; U.S. Pat. No. 5,428,853; and U.S. Pat. No. Des. 301,301.

While these devices fulfill their respective, particular objectives and requirements, the aforementioned patents do not disclose a new combination hand tool. The inventive device includes an elongate handle member with a tool member mounted on it at one end. The tool member has a plurality of flat tab portions for insertion into a slot provided on a bung and a web portion having a hex-shaped hole extending through it for engaging securing nuts provided on a bung.

In these respects, the combination hand tool according to the present invention substantially departs from the conventional concepts and designs of the prior art, and in so doing provides an apparatus primarily developed for the purpose of permitting removal of a stopper or bung from a barrel.

SUMMARY OF THE INVENTION

In view of the foregoing disadvantages inherent in the known types of hand tools now present in the prior art, the present invention provides a new combination hand tool construction wherein the same can be utilized for permitting removal of a stopper or bung from a barrel.

The general purpose of the present invention, which will be described subsequently in greater detail, is to provide a new combination hand tool apparatus and method which has many of the advantages of the hand tools mentioned heretofore and many novel features that result in a new combination hand tool which is not anticipated, rendered obvious, suggested, or even implied by any of the prior art hand tools, either alone or in any combination thereof.

To attain this, the present invention generally comprises an elongate handle member with a tool member mounted on it at one end. The tool member has a plurality of flat tab portions for insertion into a slot provided on a bung and a web portion having a hex-shaped hole extending through it for engaging securing nuts provided on a bung.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new combination hand tool apparatus and method which has many of the advantages of the hand tools mentioned heretofore and many novel features that result in a new combination hand tool which is not anticipated, rendered obvious, suggested, or even implied by any of the prior art hand tools, either alone or in any combination thereof.

It is another object of the present invention to provide a new combination hand tool which may be easily and efficiently manufactured and marketed.

It is a further object of the present invention to provide a new combination hand tool which is of a durable and reliable construction.

An even further object of the present invention is to provide a new combination hand tool which is susceptible of a low cost of manufacture with regard to both materials and labor, and which accordingly is then susceptible of low prices of sale to the consuming public, thereby making such combination hand tool economically available to the buying public.

Still yet another object of the present invention is to provide a new combination hand tool which provides in the apparatuses and methods of the prior art some of the advantages thereof, while simultaneously overcoming some of the disadvantages normally associated therewith.

Still another object of the present invention is to provide a new combination hand tool for permitting removal of a stopper or bung from a barrel.

Yet another object of the present invention is to provide a new combination hand tool which includes an elongate handle member with a tool member mounted on it at one end. The tool member has a plurality of flat tab portions for insertion into a slot provided on a bung and a web portion having a hex-shaped hole extending through it for engaging securing nuts provided on a bung.

Still yet another object of the present invention is to provide a new combination hand tool that allows the slip-free removal of bungs from barrels to help prevent scraped knuckles.

Even still another object of the present invention is to provide a new combination hand tool that allows removal of variously sized bungs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
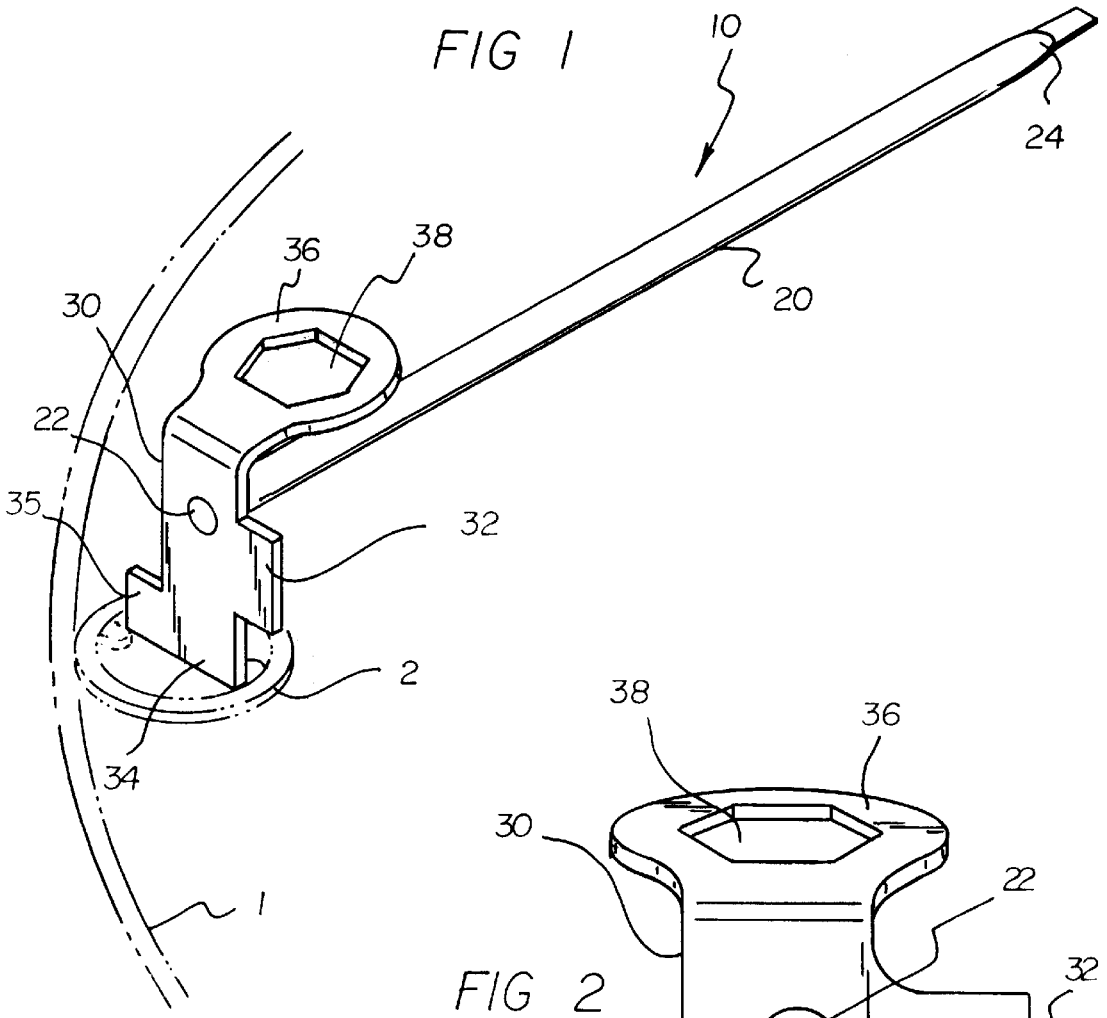
FIG. 1 is a perspective view of a new combination hand tool according to the present invention.
Figure 2:
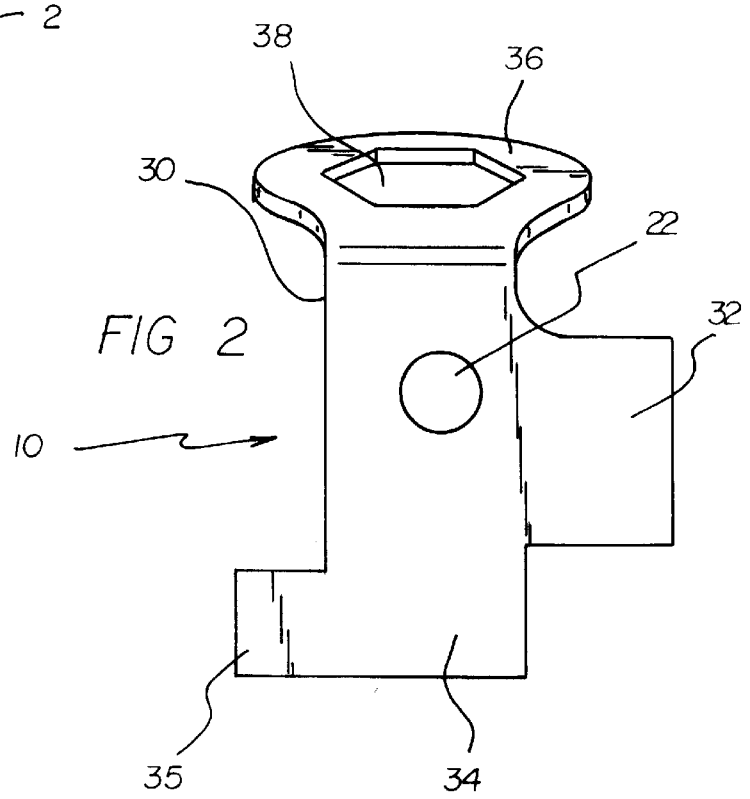
FIG. 2 is a side view of the present invention showing the tool member.
Figure 3:
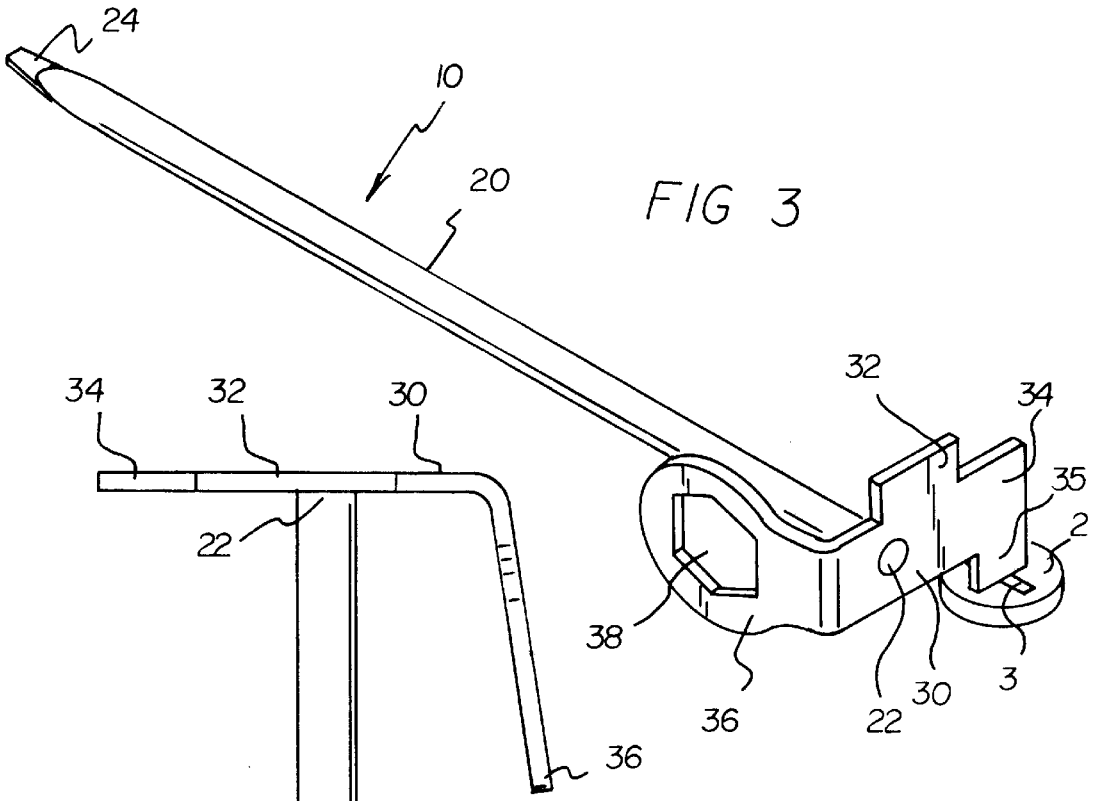
FIG. 3 is a perspective view of the present invention engaging a bung using a different tab portion than in FIG. 1.
Figure 4:
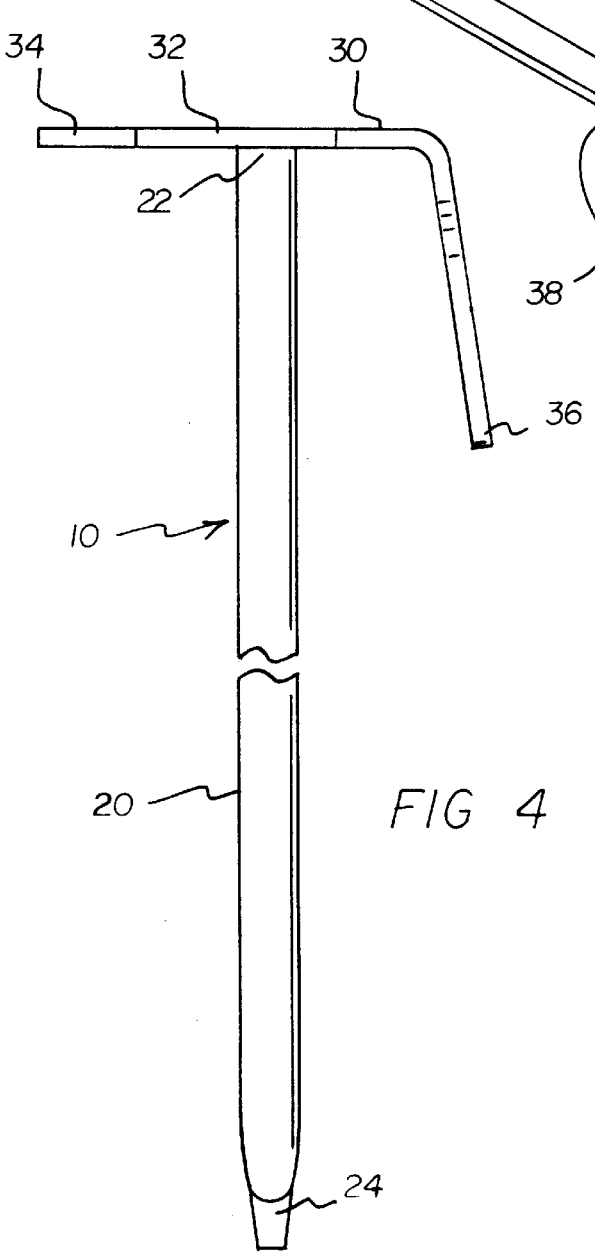
FIG. 4 is a side view of the present invention.

With reference now to the drawings, and in particular to FIGS. 1 through 4 thereof, a new combination hand tool embodying the principles and concepts of the present invention and generally designated by the reference numeral 10 will be described.

As best illustrated in FIGS. 1 through 4, the combination hand tool 10 comprises an elongate handle member 20 with a tool member 30 mounted on it at one end. The tool member 30 has a plurality of flat tab portions 32,34,35 and a web portion 36 having a hex-shaped hole 38 extending through it.

The handle member 20 has a first end 22 and a second end 24. Preferably, the handle member second end 24 is flat like the flat head of a screwdriver, so that it can be used to pry off protective plastic seals often found covering bungs 2. Ideally, the handle member 20 is cylindrical in shape to provide additional comfort while in use.

The tool member 30 is mounted to the first end 22 of the handle member 20. The tool member 30 has a web portion 36 having a hole 38 that is designed to function as an engaging means for engaging bungs 2 having securing nuts (not shown) rather than a securing slot 3. Ideally, the hole 38 is hex-shaped to engage hexshaped nuts.

The tool member 30 also has flat tabs 32,34,35 for insertion into the securing slots 3 found on slotted bungs 2. Ideally, the tool member 30 has multiple flat tab portions 32,34,35 for engaging different sized bung slots 3.

The tool member 30 is extended in a substantially perpendicular plane to the length of the handle member 20, allowing the handle member 20 to act as a lever. Similarly, the web portion 36 is extended in a substantially parallel plane to the length of the handle member 20 so that the handle member 20 can be used as a lever when using the web portion 36.

In use, the combination hand tool 10 is used to remove variously sized bungs 2 from barrels 1 by insertion of a flat tab portion 32,34,35 into the slot 3 on the bung 2 or by engaging the attachment nut (not shown) of a bung 2 by the web portion 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination hand tool for removing a bung from a barrel, comprising:

an elongate handle member having a first end and a second end;

a tool member having an engaging means for engaging hex-shaped objects wherein said engaging means is extended in a plane substantially parallel to a longitudinal axis of said handle member, and said tool member having a flat tab portion having a substantially flat edge for insertion into a slot, said tool member being mounted on said handle member first end; and wherein said handle member second end includes a planar extension, means for prying off a covering over a bung.

2. The combination hand tool of claim 1, wherein said engaging means is hole being extended through said tool member.

3. The combination hand tool of claim 2, wherein said hole is hex-shaped.

4. The combination hand tool of claim 1, wherein said handle member is cylindrical in shape to provide additional comfort while in use.

5. The combination hand tool of claim 1, wherein said tool member includes a plurality of flat tab portions.

6. The combination hand tool of claim 5, wherein said flat tab portions are of various sizes for insertion into variously sized slots.

7. A combination hand tool for removing a bung from a barrel, comprising:

an elongate handle member having a first end and a second end;

a tool member having an engaging means for engaging hex-shaped objects, and said tool member having a plurality of flat tab portions, each of said flat tab portions being for insertion into a slot, said tool member being mounted on said handle member first end;

wherein said engaging means is hole being extended through said tool member;

wherein said hole is hex-shaped;

wherein said handle member second end includes a planar extension, means for prying off a covering over a bung;

wherein said handle member is cylindrical in shape to provide additional comfort while in use;

wherein each of said flat tab portions of said tool member is extended in a plane substantially perpendicular to a plane along the length of said handle member;

wherein said engaging means is extended in a plane substantially parallel to a plane along the length of said handle member;

wherein said flat tab portions are of various sizes for insertion into variously sized slots.

8. A combination hand tool for removing a bung from a barrel, the hand tool comprising:

a substantially cylindrical elongate handle having a first end and a second end;

said second end having a substantially planar extension means for prying off a cover over the bung;

a substantially L-shaped tool member having a first flange and a second flange coupled to said first end of said handle;

a plurality of flat tab portions disposed from said first flange of said tool member, each of said flat tab portions being sized differently than each other of said flat tab portions such that each respective flat tab portion is adapted for engaging a different sized slot;

said first flange of said tool member being positioned within a plane substantially perpendicular to a plane containing said handle;

an engagement means for engaging a hexagonal object, said engagement means positioned on said second flange of said tool member;

said second flange being positioned within a plane substantially parallel to a longitudinal axis of said handle.

9. The combination hand tool of claim 8, wherein said plurality of flat tab portions comprises:

a first flat tab portion extending from said tool member, said first flat tab portion being disposed from a substantially central section of a first side of said first flange; and a second flat tab portion extending from said tool member, said second flat tab portion being disposed from a second side of said first flange proximate a distal edge of said first flange, said distal edge being opposite said second flange, and said second side of said first flange being opposite said first side of said first flange.

* * * * *